US005108202A

United States Patent [19]

Smith

[11] Patent Number: 5,108,202

[45] Date of Patent: Apr. 28, 1992

[54] WHEEL CHAIRS

[76] Inventor: Kenneth B. Smith, 20 Vioolejie Street, Alberton, South Africa, 1450

[21] Appl. No.: 464,175

[22] Filed: Jan. 12, 1990

Related U.S. Application Data

[63] Continuation-in-part of Ser. No. 415,443, Sep. 28, 1989, which is a continuation of Ser. No. 219,581, Jul. 14, 1988, abandoned.

[30] Foreign Application Priority Data

Jul. 15, 1987 [ZA] South Africa ..... 87/5165

[51] Int. Cl.[5] ..... A47C 1/02

[52] U.S. Cl. ..... 297/330; 257/DIG. 10; 257/316

[58] Field of Search ..... 257/330, DIG. 10, 347, 257/316

[56] References Cited

U.S. PATENT DOCUMENTS

| | | | |
|---|---|---|---|
| 2,572,149 | 10/1951 | Hind et al. | 297/DIG. 10 |
| 2,641,306 | 6/1953 | Lerman | 297/DIG. 10 |
| 3,259,427 | 7/1966 | Wiest . | |
| 3,379,450 | 4/1968 | Jones et al. . | |
| 3,629,880 | 12/1971 | van Rhyn . | |
| 3,640,566 | 2/1972 | Hodge . | |
| 3,937,519 | 2/1976 | Schoolden | 297/DIG. 10 |
| 3,954,195 | 5/1976 | Deucher . | |
| 4,076,304 | 2/1978 | Deucher . | |
| 4,231,614 | 11/1980 | Shaffer . | |
| 4,456,086 | 6/1984 | Wier et al. . | |
| 4,519,649 | 5/1985 | Tanaka et al. | 297/316 |
| 4,552,404 | 11/1985 | Congleton | 297/330 |
| 4,569,556 | 2/1986 | Pillot . | |
| 4,623,194 | 11/1986 | Pillot | 297/316 |

FOREIGN PATENT DOCUMENTS

| | | |
|---|---|---|
| 2625047 | 12/1976 | Fed. Rep. of Germany . |
| 2625046 | 12/1977 | Fed. Rep. of Germany . |
| 2553650 | 4/1985 | France . |

*Primary Examiner*—Peter A. Aschenbrenner
*Attorney, Agent, or Firm*—Charles Berman

[57] ABSTRACT

A wheelchair with a seat on which a patient can sit, a back rest for the patient when sitting on the seat, and a lifting device for lifting a patient in the wheel chair into a standing position. The lifting device being a jack with manually operable mechanism for extending said jack and a linkage connecting the jack to the seat and to the backrest and including a parallel movement link means. The arrangement being such that on extension of the jack, the seat and back rest will be moved with the back rest carrying out movement in a substantially parallel direction so that the patient will be moved from a sitting position to substantially a standing position.

12 Claims, 6 Drawing Sheets

WHEEL CHAIRS

CROSS-REFERENCES

Figure 1:
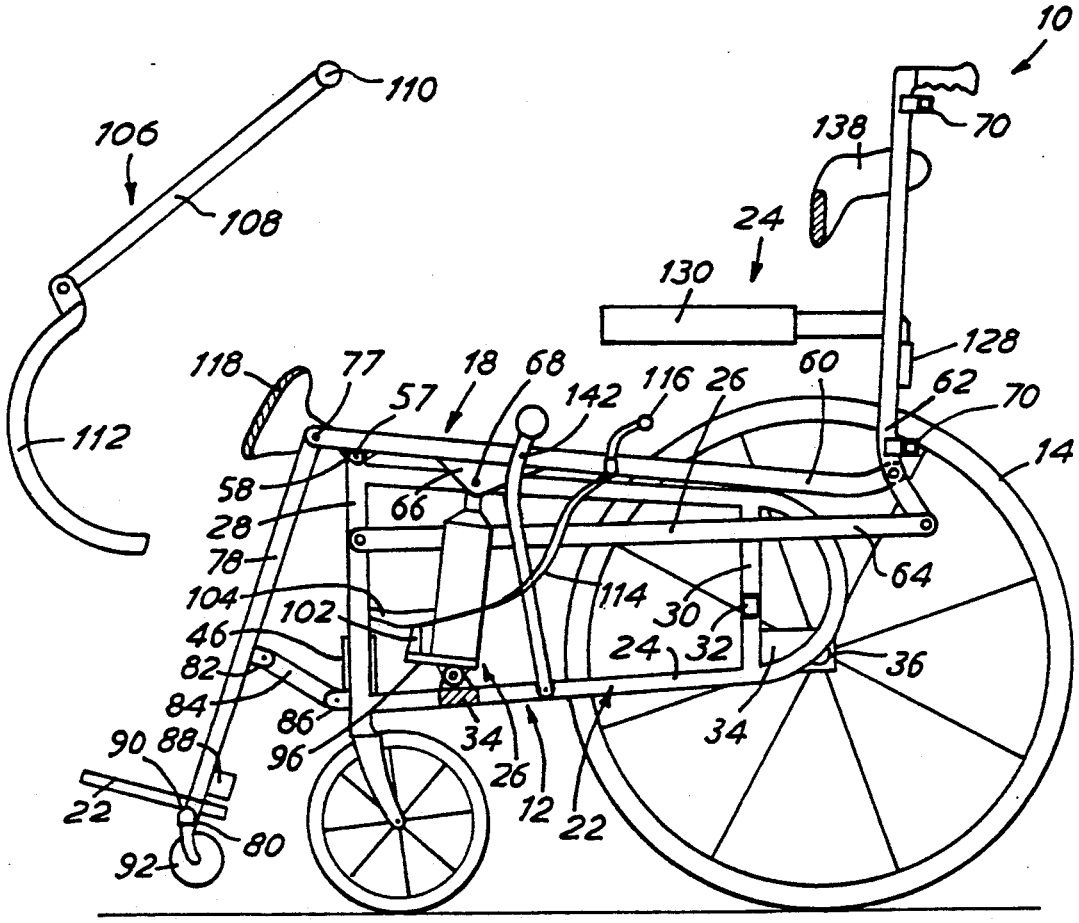

This application is a continuation-in-part of application Ser. No. 07/415,443 by Kenneth Brian Smith, filed Sep. 28, 1989, and entitled "Wheel chairs," which was a continuation of application Ser. No. 07/219,581 (now abandoned) by Kenneth Brian Smith, filed Jul. 14, 1988, and also entitled "Wheel Chairs," both of which are incorporated herein by this reference.

Although wheel chairs provide paraplegics and others who have lost the use of the legs (hereinafter called "patients") with a degree of mobility, they unfortunately do have certain disadvantages. Thus, a patient in a wheel chair is restricted as to the height of items that he can reach. Furthermore he remains in the sitting position which, because of his inability to feel, may result in sores and which keeps his internal organs in fixed positions.

Various forms of apparatus has been devised to enable a wheel chair bound patient to be able to stand. There are a number of kinds of such apparatus. One kind of apparatus requires external power. This is typically a hydraulic device as exemplified by U.S. Pat. No. 4,456,086 (Weir), U.S. Pat. No. 3,379,450 (Jones et al) and U.S. Pat. No. 4,552,404 (Congelton) which appear to be extremely heavy and complicated and would not, it seems, be capable of being incorporated in a normally mobile wheel chair. Another kind of externally powered wheel chair is an electric motor operated device as disclosed in U.S. Pat. No. 4,076,304 (Deucher) and Offenlegungsschrift 26 25 047 (Deucher). Such devices normally have a very limited operating time due to the amount of power that must be drawn from the battery. Furthermore the apparatus is very heavy and difficult for the patient to move.

A further kind of such apparatus is operated by the patient in the wheelchair. Such apparatus may use large levers which the patient must pull forward to lift himself. Typical such apparatus are disclosed in U.S. Pat. Nos. 4,569,556 and 4,263,194 (both Pillot), U.S. Pat. No. 4,519,649 (Tanaka) and 3,640,566 (Hodge). Although these apparatus may include a spring or a gas cylinder to assist in lifting the patient, the patient must have considerable strength to operate the apparatus. Certainly a quadriplegic would not be able to operate such apparatus but even for a paraplegic strength and suppleness including the ability to reach quite far behind the body seems to be a prerequisite for operation. It will be noted that such a disadvantage cannot be overcome merely by increasing the strength of the spring or gas cylinder as this will have the effect of making the sitting operation much more difficult as the patient must overcome the strength of the spring or gas cylinder in so doing. In addition it would seem that the various linkages are extremely complicated.

Another apparatus operated by a patient is illustrated in U.S. Pat. No. 2,572,149 (Hind et al). Here a threaded bolt passing through a captive nut causes the seat part and back rest to move into the upright position. This arrangement is ungainly and awkward in construction with the bolt projecting far back beyond the wheel chair handles to an extent where it is likely to interfere with what occurs behind the wheel chair. This patent also shows the use of an additional set of castors at the front of the wheel chair to support a person in the wheel chair when in the standing position. These castors are fixed on a plate that is attached to the footrest which is in turn fixed to the frame of the wheel chair.

A further apparatus operated by a patient is illustrated in U.S. Pat. No. 3,629,880 (Van Rhyn). This apparatus includes a complicated chain and sprocket drive and certainly does not appear to be able to operate as a wheelchair.

It is an object of the invention to provide a wheel chair which would enable a patient to move from a sitting position to a standing position and which is easy to operate and of reasonable size and mass.

It is a further object of the invention to provide a wheel chair which would enable a patient to raise himself to the standing position without the requirement of external power.

It is yet a further object of the invention to provide a wheel chair which would permit a third person to raise the patient into the standing position without the requirement of an external power source.

It is another object of the invention to provide a wheel chair which would enable a patient to stand and which is capable of movement when the patient is in the standing position.

It is a further object of the invention to provide a wheel chair would enable a patient to raise himself to the standing position without the requirement of external power and which provides a pair of arm rests for the patient both in the sitting and standing position.

According to one aspect of the invention there is provided a wheelchair comprising a seat on which a patient can sit, a back rest for the patient when sitting on the seat, and a lifting device for lifting a patient in the wheel chair. into a standing position, the lifting device comprising a jack, manually operable means for extending said jack and a linkage connecting the jack to the seat and to the backrest and including a parallel movement link means; the arrangement being such that on extension of the jack, the seat and back rest will be moved with the back rest carrying out movement in a substantially parallel direction so that the patient will be moved from a sitting position to substantially a standing position.

The device further preferably comprises a footrest which is movable downwardly from a travel position when the seat and back rest are in the sitting position to a support position when the latter are in the standing position, the footrest is carried on a small castor, which when the foot-rest is in the support position engages the ground and when the footrest is in the travel position is clear of the ground.

An embodiment of the invention will now be described by way of example with reference to the accompanying drawings.

SHORT DESCRIPTION OF DRAWINGS

Figure 2:
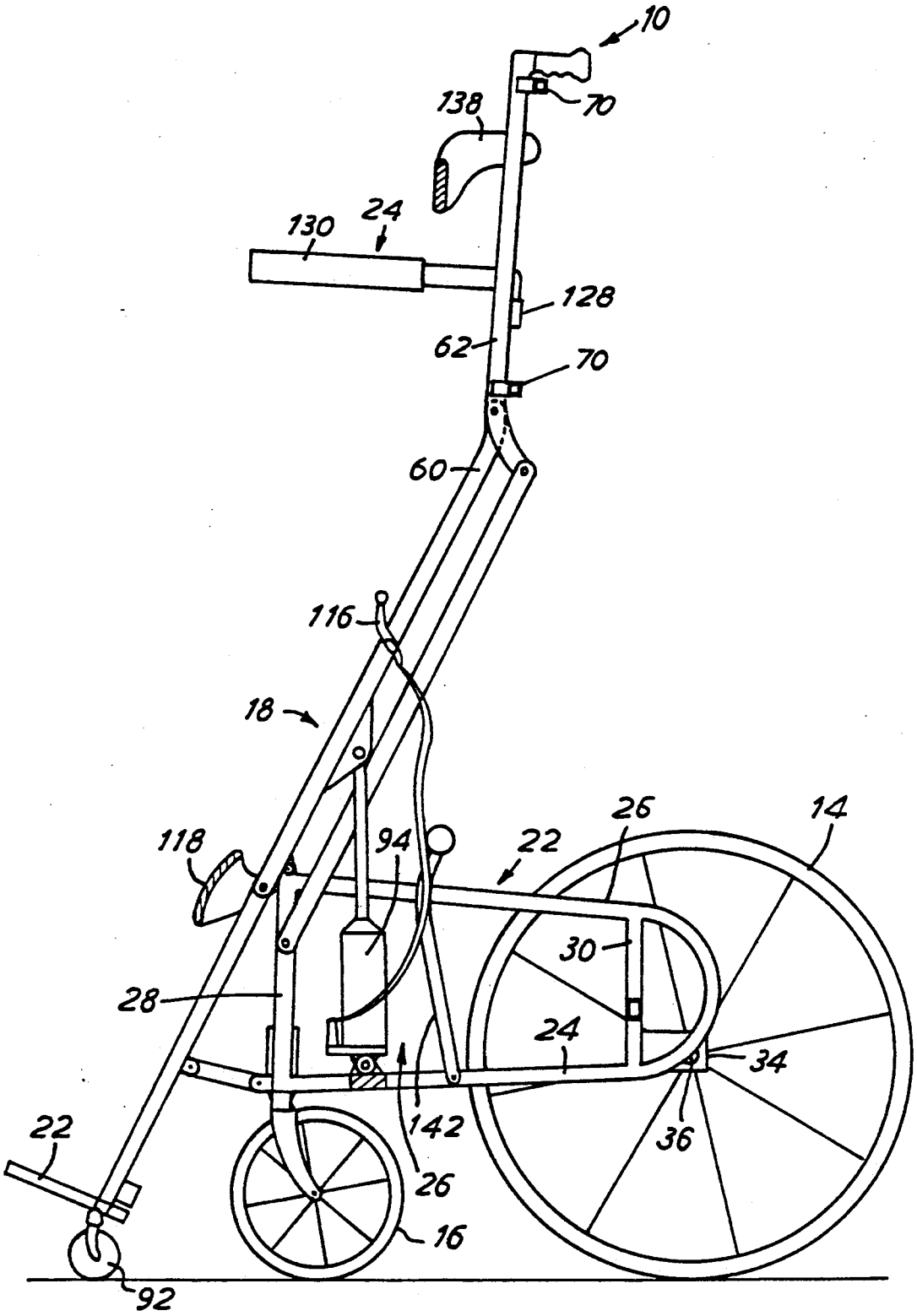
Figure 3:
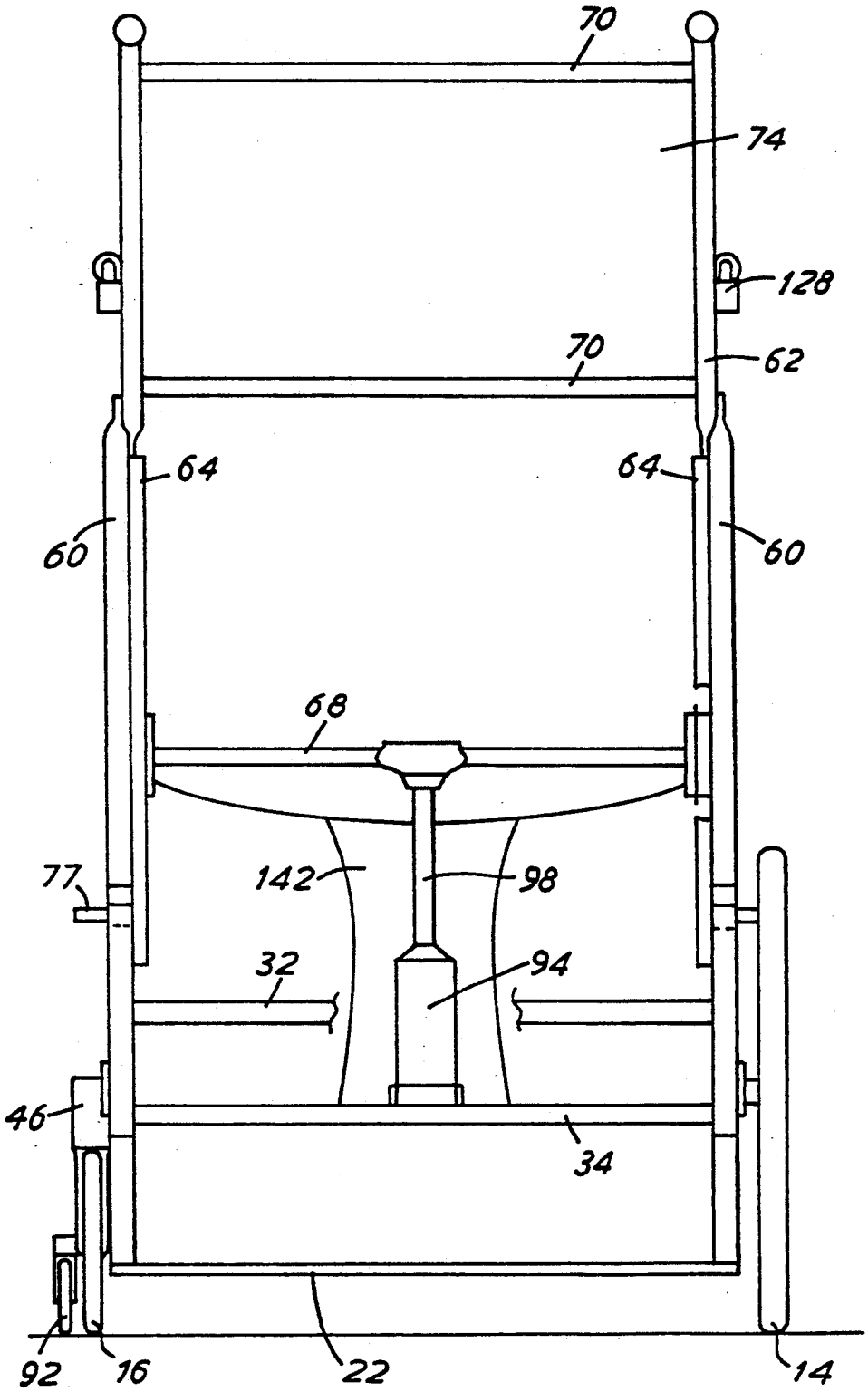
Figure 4:
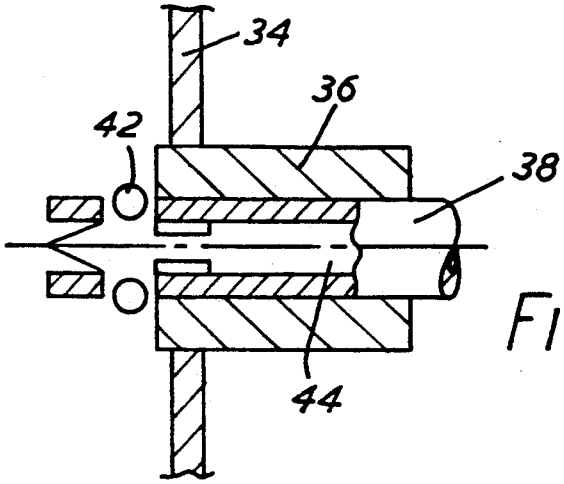
Figure 5:
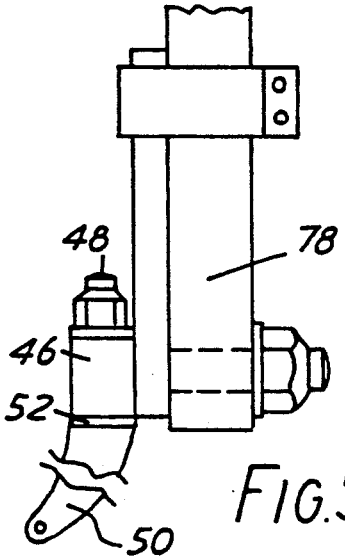
Figure 6:
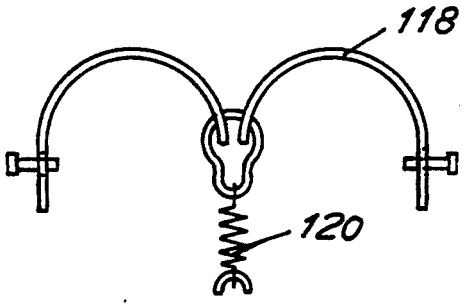
Figure 7:
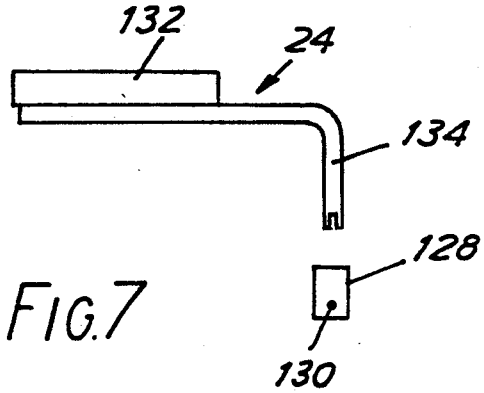
Figure 8:
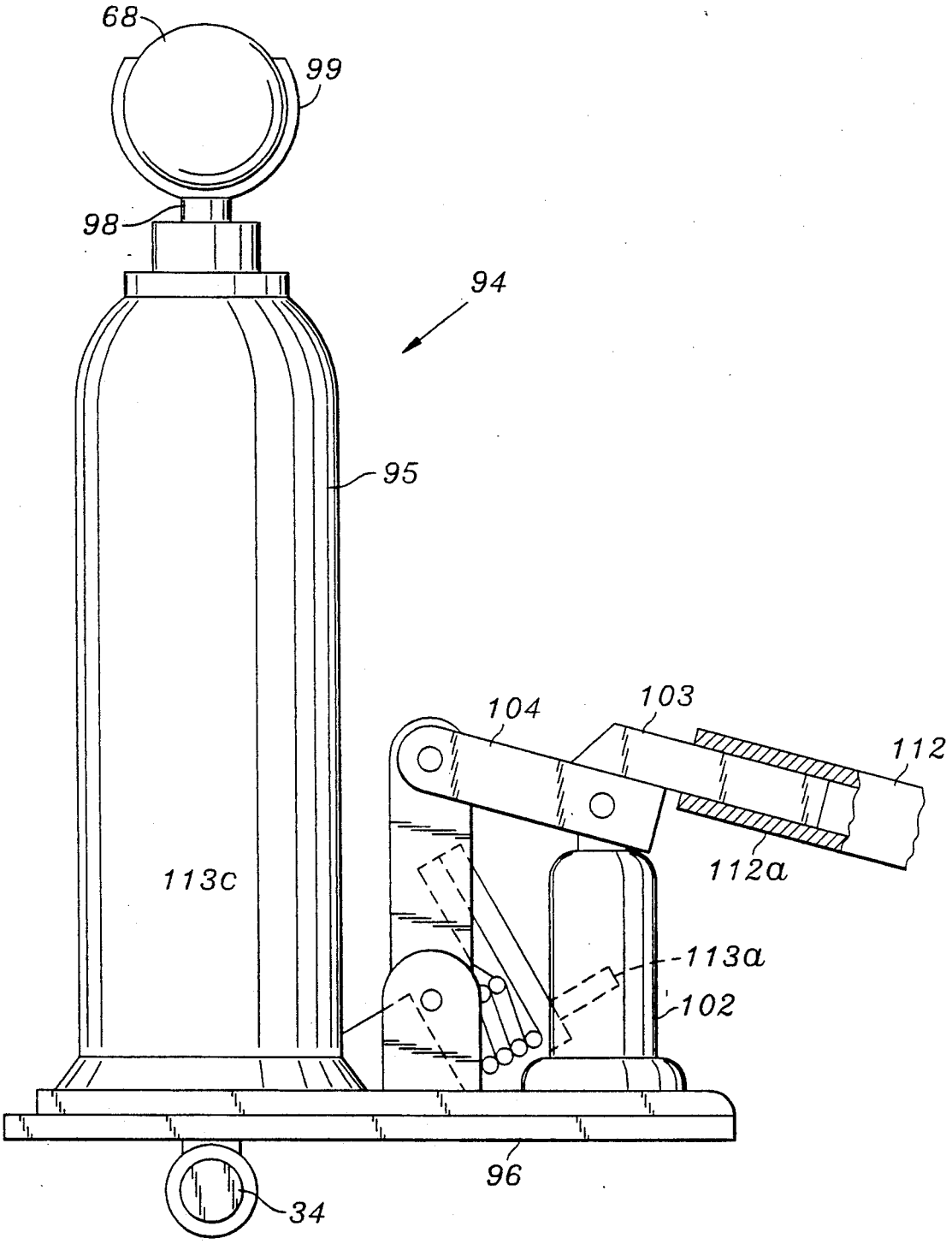
Figure 9:
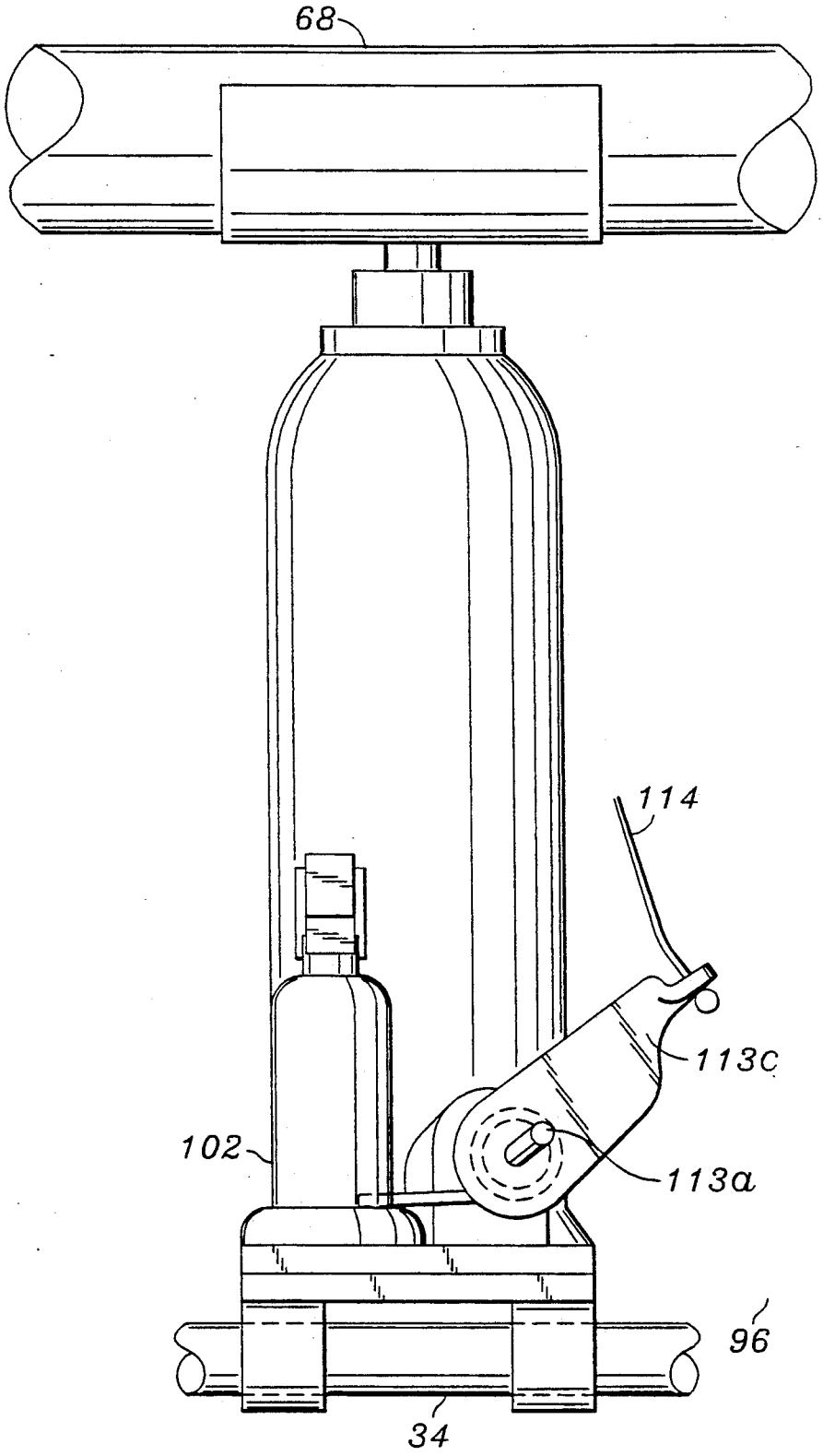

FIG. 1 is a diagrammatic side view of a detail of an attachment for a wheel the chair of the invention in the sitting position, FIG. 2 is a detail similar to FIG. 1 of the attachment in the standing position, FIG. 3 is a detail view in the direction of arrow 3 in FIG. 2, with one wheel omitted for clarity, FIG. 4 is a section through the main wheel attachment, FIG. 5 is a view of the attachment device for the front castors, FIG. 6 is a plan of the knee pieces, FIG. 7 is a detail of the arm rests, FIG. 8 is an enlarged detail side view of the bottle jack, and FIG. 9 is another detail side view of the bottle jack.

Referring now to the drawings, there is shown a wheel chair 10 comprising a subframe 12 carrying ground engaging means in the form of a pair of main wheels 14 and a pair of front castors 16, and a seat or patient support means comprising a seat part 18, a back rest 20, foot supports 22 and arm rests 24.

The wheel chair 10 further comprises lifting means 25 that is capable of lifting the seat part 18 and the back rest 20 from a "sitting" position (as shown in FIG. 1) in which the seat part 18 is substantially horizontal and the back rest 20 is substantially vertical and a "standing" position (as shown in FIG. 2) in which the seat part 18 is almost vertical and the back rest 20 remains substantially vertical.

The sub-frame 12 comprises two substantially "U"-shaped side members 22 with the arms 24 and 26 lieing substantially horizontal. An end vertical member 28 joins the ends of the arms 24 and 26 of each side member 22 and an inner vertical member 30 joins these arms near the curved base of the "U".

A bearing plate 34 is secured to each side member 22 being welded to the inner member 30 and the lower arm 24 at the base of the "U". A bearing 36 (see FIG. 4) is attached to the bearing plate 34 and this receives a hollow stub-axle 38 on which one of the main wheels 14 is carried. Within the axle 38 is a movable pin 40 which acts as an inner race for three ball bearings 42 that project through openings in the axle 38 and bear against the inner surfaces of the bearings 36 to hold the sub-axle 38 in place. The pin 14 has a peripheral recess 44. By moving the pin 14 inwardly against the bias of a spring (now shown) the recess 44 will be adjacent the ball bearings 42 so that these can fall into the recess in which position they do not project through the axle 38 so that this can be removed from the bearing 36.

At the outer end of each lower arm 24 there is a vertical bearing 46 (see FIG. 5) in which is received the shank 48 of a bifurcated carrier 50 for a front castor 16. A flange 52 on the shank 48 acts on a thrust bearing 54 carried by the bearing 46. A similar locking device to that described in the preceding paragraph is provided to hold the castor 16 removably in the bearing 46.

Each end vertical member 28 projects at 56 above the upper arm 26 and has a bearing 57 that receives a pin 58 on a plate 59 carried by a side rod 60 (hereinafter called the "seat member") forming part of the seat part 18. The remote end 61 of the rod 60 is slightly curved and is pivoted to a side rod 62 (hereinafter call the "back rest member") of the back rest 20.

The lower ends of the back rest members 62 extend beyond the seat members 60 and are there pivoted respectively to the ends of parallel motion links 64 that are pivoted to the end vertical member 28 near its upper end. The geometry is so arranged that irrespective of the movement of the seat members 62, the back rest 20 will remain substantially vertical.

The seat members 60 carry a pair of triangular plates 66 about quarter way along their length. These plates 66 are joined by a robust cross-rod 68. Two slightly lighter cross-rods 70 join the back rest members 62. A leather sling 72 (see FIG. 3) spans the members 60 to form a seat and a similar sling 74 spans the members 62 to form a back rest.

The front ends 76 of the seat rods 60 extend beyond the projections 56 and are there pivoted respectively by means of pivot pins 77 to the upper ends of foot-rest support members 78 joined at their lower ends by a cross-shaft 80. Each support member 76 has a lug 82 formed thereon about midway along its length and pivoted on to a link 84 that is pivoted to a lug 86 projecting from the end vertical member 28.

The cross shaft 80 carries the foot supports 22 in such manner that these can pivot from a horizontal patient supporting position to an upward storage postion. Heel slings 88 of leather or canvas are provided at the rear of the foot supports 22.

The lower ends of the members 78 have projecting plates 89 carrying vertical bearings 90 receiving the shanks of small castors 92.

The lifting means 25 comprises an hydraulic jack 94 which is conventional in construction. The jack 94 has a cylinder 95, the lower end of which is carried centrally of a plate 96 that is pivotally mounted on the cross member 34. The free end of the piston rod 98 of the jack 94 carries an arcuate section member 99 that receives and rotatably engages the cross-rod 68.

The jack 94 incorporates a reciprocating pump 102 having a pump lever 104 for reciprocating the plunger 100. One end of this lever 104 is pivotally attached to one end of a vertical member 101, the other end of which is received between and pivotted to a pair of lugs 97 carried by the plat 96. The pump lever 104 has a solid extension piece 103 that projects beyond the plunger 100.

A two part manually operable operating lever or pivotted crank 106 is provided. The operating lever or crank 106 has an upper part 108 with a cross-bar 110 to facilitate manipulation thereof and a curved lower part 112 pivoted thereto. The lower part 112 has a socketted end **112*a* and is preferably of square section hollow tube to provide such a socketted end. The socketted end 112*a* receives the free end of the extension piece 103 on the pump lever 104. Thus a patient can easily pump up or crank the jack 94** to cause it to extend as will be described.

The jack 94 incorporates a release mechanism. This mechanism comprises a valve (not shown) movable by a pin **113*a* that rotatably engages the body 113*b* of the jack 94. A release lever 113*c* is carried by the pin 113*a* and is biassed into the position in which the valve is closed by a spring 117. The lever 113*c* is connected to a cable 114 that extends to a lever 116 pivottally carried by the one of the rods 60. The cable 114 is a Bowden type cable, the sleeve 114*a* of which is attached to the member 101, the cable passing through an opening in that member 101. The end of the cable 114 passes through an opening in the lever 113*c* is wound around a securing member 113*d* and then returns through the opening to be secured to the cable 114 by a gromment 113*f*** which is crimped on to the two parts of the cable.

Movement of the lever 116 draws the cable 114 upwardly rotating the pin **113*a* against the bias of a spring 117 to open the valve thereby allowing the fluid to flow in the jack cylinder allowing the piston rod to return into the cylinder and permitting the seat part to return to its initial horizontal seating position. The size of the lever 104 is such that its operating end is readily accessible to a patient standing on the chair 10 to enable him to release the pressure in the jack 94**.

A pair of padded leather knee pieces 118 are provided (best shown in FIG. 6). The inner ends of these knee pieces 118 are secured to a spring member 120 the inner ends of which is secured to the cross rod 68 by means of a spring 122. The outer ends of the knee pieces 118 have a series of three openings 124 that can engage a projecting part of the pivot pin 77 projecting from the members 60 and 78. Thus the patient can secure his knees firmly by the knee pieces 118.

At about the mid-portion of each back rest member 62 there is a cylindrical socket 128 (see FIG. 7) having an internal cross-piece 130. The tubular arm rest 24 which has a padded horizontal portion 132 has a vertical carrier 134. The carrier 134 can fit easily into the socket 128 and has a lower end formed with a cross-slot 136 in which the crosspiece 130 can be received.

A chest strap 138 is provided near the sockets 128 to enable the patient to strap himself to the wheel chair 10.

A length of leather 142 depends from the seat part to hide (to a large extent) the jack from sight. A brake device (not shown) that acts on the rear wheels 14 is operated by a robust level 142 pivoted to the lower arm 24 of one of the "V" frames 22.

In order that the wheel chair can be easily transported in the boot (or trunk) of a motor vehicle, the wheels 14 can be removed as described as can the arm rests 24. The pivot pin between the parallel motion links 64 and the vertical members can be disengaged against a spring bias so that the back rest 20 can be flat on the seat 18. In addition the pivot pins 77 are movable to release the support members 78 from the rods 60 and the links 84 are disconnectable from the lugs 86. Thus the support arrangement (i.e. the members 78 and foot rests 80). All of these may comprise quick release pins.

In use, a patient enters into the assembled wheel chair with the seat part 18 in the horizontal seating position. The knee pieces 118 are fitted into position clamping the legs firmly in place and attached to the pivot pins 77. The chest strap 138 is then applied to the chest of the patient. The patient can move about in the wheel chair 10 in much the same as in a conventional wheel chair.

When the patient wishes to stand, the patient attaches the operating lever 106 to the free end of pump lever 104 of the jack 94 receiving the extension piece 103 in the socketted end **112*a* of the lower part 112. By moving the lever 106 up and down the patient pumps the jack pump. The jack 94 will expand moving the seat member 18 upwardly and moving the back member 20 in a parallel direction. It will be seen that the seat members 60 rotate within the bushes 58 which has the effect of moving the leg attachment 78 downwardly until such time as the small castors 92 engage the ground and the front castors are lifted off the ground. The final position of the members 18 and 20 is such that the patient will be leaning back slightly as is apparent from FIG. 1** with his centre of gravity well back. The patient can be held in the standing position. This improves the patient's circulation and also changes the position of the patient's internal organs which assists the patient's well being. The patient can reach high shelves and other objects which would not normally be accessible to the patient. If there are fixed parts which the patient can grip, the patient can move the wheelchair moving the patient in the standing postion.

By releasing the pressure in the jack 94 by the lever 116 and the cable 114, the patient will be lowered back into the sitting position.

It have found that the wheel chair holds the patient firmly in the standing position so that the patient can feel confident and will not (except in extreme circumstances) fall either forward or sideways.

I have further found that the wheel chair and attachment as described above easy for a patient to operate with confidence. In addition if necessary a third person can operate the jack to lift the patient into the standing position without the third person approaching so close to the patient to an extent which would be embarrassing. Furthermore it is relatively inexpensive using simple equipment.

The invention is not limited to the precise constructional details hereinbefore described and illustrated.

I claim:

1. A wheelchair comprising:

a) a frame, b) frame wheels mounted on the frame, c) a seat part having a front end and a rear end and being pivotally mounted on the frame at pivot connection means near said front end to move from a generally horizontal sitting position to an upright standing position, said front end of said seat part extending beyond said pivot connection means;

d) a back rest for the patient when sitting on said seat part, said back rest having upper and lower parts and being pivotally connected near its lower part to the rear end of the seat part, e) a lifting device for lifting a patient sitting on said seat part into a standing position, said lifting device comprising (i) a jack carried by the frame, (ii) manually operable means attached to said jack for extending said jack, (iii) connecting means connecting said jack to said seat part so that on extension of said jack, said seat part will pivot about said frame from said sitting position to said standing position, and (iv) link means having one end pivoted to said frame at a location close to said pivot connection means and having its other end connected to said lower part of said back rest on the side of its connection with said seat part remote from said upper part, said link means constraining the movement of said back rest so that it remains in a substantially upright position on movement of the seat part;

f) a footrest assembly, g) ground engaging wheel means on said footrest assembly, h) footrest link means connecting said footrest assembly to said front end of said seat part, i) a restraining linkage connected to said frame and to said footrest link means constraining movement of said footrest link means, said link means moving said footrest assembly from a first position in which said wheel means is off the ground when said seat part is in the sitting position to a second position in which said wheel means engage the ground when said seat part is in the standing position so that the wheelchair is supported on said frame wheels and said ground engaging wheels to enable said wheelchair to be moved with the patient in the standing position.

2. A wheelchair as claimed in claim 1 further comprising:

j) a sub-frame on which said seat part is carried, and k) side members forming part of said seat part, said side members being pivoted to said sub-frame near one end thereof and being pivoted to said footrest linkage at said ends, h) connecting members hinged at their ends respectively to said footrest linkage and to said sub-frame so that when said seat part is moved, the relative position of the footrest assembly to the sub-frame varies.

3. A wheelchair comprising:

a) a frame, b) a pair of rear ground engaging wheels carried by said frame, c) a pair of front ground engaging wheels carried by said frame, d) a seat comprising:

(i) a seat part having front and rear ends and being pivoted to said frame at pivot connection means near to said front end so as to be capable of moving from a generally horizontal sitting position to an upright standing position, (ii) a back rest having upper and lower ends and being pivoted to said seat part near to said lower end, (iii) link means pivotally connected at one end to said lower end of said back rest and at its other end to said frame near to said connection means so that movement of said back part will maintain a generally upright disposition during movement, e) a foot rest, f) connecting links connecting said foot rest to the front end of said seat part, g) control linkage means connecting said links to said frame to constrain its movement so that when said seat part moves to the standing position, said connecting link moves said foot rest from an upper position to a lower position relative to said frame, and h) wheel means carried by said foot rest, said wheel means being clear of the ground when said foot rest is in the upper position and engaging the ground when said foot rest in said lower position so that said frame is carried by said rear wheels and said wheel means.

4. A wheelchair as claimed in claim 2 further comprising:

i) lifting means pivotally mounted on said frame and being pivotally connected to said seat part for lifting the seat from the sitting position to the standing position so that a person in the wheelchair is moved from a sitting position to a standing position.

5. A wheelchair as claimed in claim 3 further comprising a jack means connected between said frame and said seat part and being operable to move said seat part relative to said frame from said seating position to said standing position.

6. A wheelchair as claimed in claim 5 in which said jack means comprises:

a) a support member pivotally connected to said frame, b) a bottle jack mounted on said support member and having a piston rod which is connected to said seat part, c) a pump carried by said support member and having ram means and a lever pivotally carried by said support member and being connected to said ram means to cause it to reciprocate within the pump when said lever pivots relative to said support member thereby to operate said pump, the wheelchair further comprising an operating link having d) a handle at one end whereby a person in the wheelchair can grasp the link to manipulate it, and e) connecting means at the other end engaging said lever so that on movement of said operating link the lever will be caused to pivot thereby reciprocating said ram, whereby said person can operate the pump by moving said link.

7. A wheelchair as claimed in claim 6 in which said link comprises two parts which are pivotted together.

8. A wheelchair as claimed in claim 7 in which said connecting means comprises a socket into which the end of said pump lever is receivable.

9. A wheelchair as claimed in claim 6 in which said jack means comprises a release mechanism that when operated permits said jack means to contract and further comprising a hand lever member carried by said seat, said hand lever member being connected by cable means to said release mechanism to operate said release mechanism.

10. A wheelchair as claimed in claim 3 in which said wheel means comprises a pair of castors.

11. A wheelchair as claimed in claim 10 in which the diameter of said castors is less than the diameter of said front wheels.

12. A wheelchair as claimed in claim 6 in which said seat further incorporates a pair of arm rests.

* * * * *